US007798038B2

(12) United States Patent
Junkers

(10) Patent No.: US 7,798,038 B2
(45) Date of Patent: Sep. 21, 2010

(54) REACTION ARM FOR POWER-DRIVEN TORQUE INTENSIFIER

(76) Inventor: John K. Junkers, 14 Algoquin Trail, Saddle River, NJ (US) 07458

( * ) Notice: Subject to any disclaimer, the term of this patent is extended or adjusted under 35 U.S.C. 154(b) by 0 days.

(21) Appl. No.: 11/926,376

(22) Filed: Oct. 29, 2007

(65) Prior Publication Data

US 2009/0107297 A1 Apr. 30, 2009

(51) Int. Cl.
*B25B 21/00* (2006.01)

(52) U.S. Cl. ..... 81/57.14

(58) Field of Classification Search ..... 81/54, 81/57.14, 467, 469

See application file for complete search history.

(56) References Cited

U.S. PATENT DOCUMENTS 3,830,119 A * 8/1974 Travis ..... 81/477
4,155,278 A * 5/1979 Estok ..... 81/57.11
4,484,871 A * 11/1984 Adman et al. ..... 418/69
4,513,827 A 4/1985 Dubiel
4,522,269 A 6/1985 Adman et al.
4,573,370 A 3/1986 Clemens
5,730,232 A 3/1998 Mixer
5,954,144 A * 9/1999 Thames ..... 173/216
2005/0034276 A1 2/2005 Badiali

FOREIGN PATENT DOCUMENTS

EP 1 595 655 11/2005
RU 2 112 639 6/1998

* cited by examiner

*Primary Examiner*—Hadi Shakeri
(74) *Attorney, Agent, or Firm*—Michael J. Striker

(57) ABSTRACT

A reaction arm for a power-driven torque intensifier having a housing with an axis, a torque intensifier unit and a switching device for switching the torque intensifier unit between high speed/low torque and low speed/high torque, is configured for operating the switching device so that when the reaction arm is placed in a first position, the torque intensifier unit is switched to high speed/low torque and the reaction arm is usable as a handle by an operator, and when the reaction arm is placed in a second position the torque intensifier unit is switched to low speed/high torque and the reaction arm can abut against a stationary object since the high torque can not be absorbed by the operator.

6 Claims, 1 Drawing Sheet

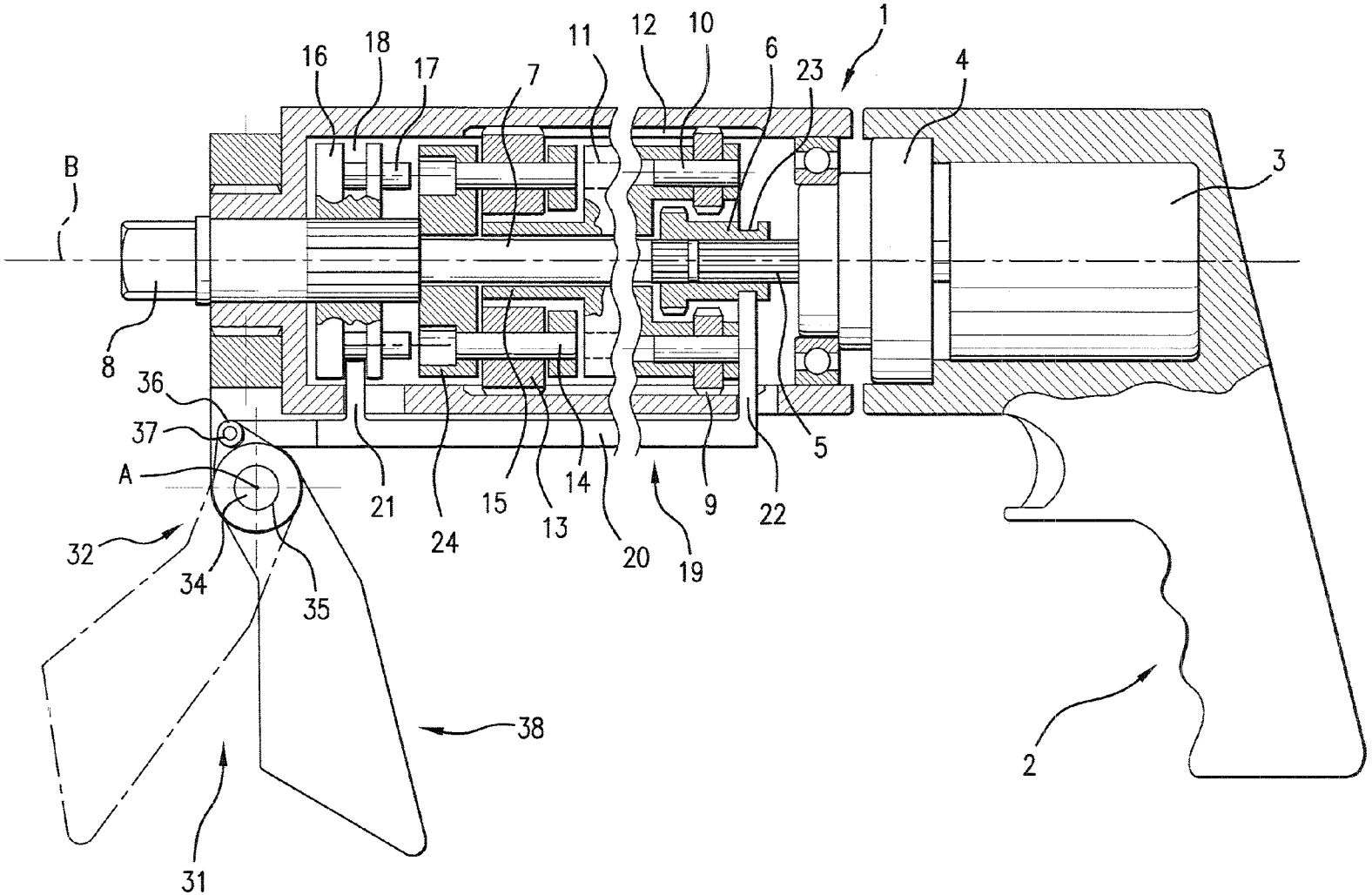
1
2
3
4
5
6
7
8
9
10
11
12
13
14
15
16
17
18
19
20
21
22
23
24
31
32
34
35
36
37
38
A
B

REACTION ARM FOR POWER-DRIVEN TORQUE INTENSIFIER

BACKGROUND OF THE INVENTION

The present invention relates to reaction arms for power-driven torque intensifiers, as well as to power-driven torque intensifiers provided with reaction arms.

Power-driven torque intensifiers or torque multipliers are available to be used with two speeds, including one high speed to run down a nut on a bolt or the like or to run up the nut, and one low speed to apply a high torque to the nut in order to tighten or loosen the nut.

The torque intensifiers require the use of reaction means to divert a reaction force generated during turning of the nut, to a stationary object. This brings along a problem that a run down speed needs to be limited to avoid that the reaction arm, that usually abuts against a nut adjacent to the nut to be tightened, is slammed against the nut at a high speed, which could cause an accident if the operator's fingers are in the way.

The same problem arises when a torque intensifier is used in a way that the gear mechanism and the gear housing turn at a given speed in the same direction for run down and run up, and in opposite directions to tighten or loosen a nut, because while an abutment of reaction arm is necessary for the second-mentioned mode of operation, it is not desirable for the first-mentioned mode of operation, again to avoid accidents.

SUMMARY OF THE INVENTION

Accordingly, it is an object of the present invention to provide a reaction arm for a power-driven torque intensifier, as well as a power-driven torque intensifier with a reaction arm, which avoid the above mentioned disadvantages of the prior art.

In keeping with these objects and with others which will become apparent hereinafter, one feature of the present invention resides, briefly stated, in a reaction arm for a power-driven torque intensifier having a housing, torque intensifier means and switching means for switching the torque intensifier means between high speed/low torque and low speed/high torque, said reaction arm being configured for operating said switching means so that when said reaction arm is placed in a first position, the torque intensifier means is switched to high speed/low torque and the reaction arm is usable as a handle by an operator, and when said reaction arm is placed in a second position, the torque intensifier means is switched to low speed/high torque and said reaction arm can abut against a stationary object since the high torque can not be absorbed by the operator.

Another feature of the present invention resides, briefly stated, in a power-driven torque intensifier with a reaction arm, comprising the power-driven torque intensifier having a housing, torque intensifier means and switching means for switching the torque intensifier means between high speed/low torque and low speed/high torque; and the reaction arm configured for operating said switching means so that when said reaction arm is placed in a first position, the torque intensifier means is switched to high speed/low torque and the reaction arm is usable as a handle by an operator, and when said reaction arm is placed in a second position the torque intensifier means is switched to low speed/high torque and said reaction arm can abut against a stationary object since the high torque can not be absorbed by the operator.

When the reaction arm is designed in accordance with the present invention, then in one instance it can be used as a handle, while in another instance it can be used as a reaction arm to abut against one of adjacent stationary objects.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a cross-section of a power-driven torque intensifier with a reaction arm in accordance with the present invention.

DESCRIPTION OF THE PREFERRED EMBODIMENTS

A power-driven torque intensifier shown in the drawings has a housing which is identified with reference numeral 1 and is provided with a handle 2. The torque intensifier has a motor 3, and a single stage gear multiplier 4, for example of a planetary type, which is driven by the motor 3 and has an output shaft 5.

A multi-stage planetary gear set is accommodated in the housing 1 and includes, for example, a first stage and a second stage. The first stage includes a sun gear 6 which internally engages with the output shaft 5 and is internally engageable with a drive shaft 7, for example by interengaging splines provided on an inner surface of the sun gear 6 and on outer surfaces of the output shaft 5 and the drive shaft 7. On its output end the drive shaft 7 has an engaging member formed, for example, as a square-shaped end portion 8. The first stage further has satellite gears 9, which are mounted on shafts 10 held in a carrier 11. The satellite gears 9 have outer surfaces provided with a plurality of teeth which are engaged with corresponding formations that are formed on the inner surface of the housing 1, for example, internal teeth 12.

The second stage has a sun gear which is formed by a part 15 of the carrier 11 of the first stage, and planetary gears 13. The planetary gears 13 are arranged on shafts 14, which are carried by a carrier 24, and engage with the inner surface of the housing 1, in particular with the internal teeth 12 of the housing 1.

The torque intensifier is further provided with two couplings which are operative for switching the modes of operation, as will be explained herein below. They include a first coupling 16 which is mounted on the drive shaft 7 for joint rotation therewith, for example by interengaging splines. It is provided with engaging elements 17 formed, for example, as short rods, and with a receiving groove 18. The second coupling is formed by the sun gear 6 of the first stage of the multistage planetary gear set.

Switching means are further provided for switching the torque intensifier between the corresponding modes of operation and include a switching element 19. The switching element 19 has an elongated rod 20, which has a first projection 21 engaging in the receiving groove 18 of the first coupling 16, and a second projection 22 engaging in a receiving groove 23 of the second coupling or sun gear 6.

A reaction arm in accordance with the present invention is identified with reference numeral 31. It has a part 32 which is pivotally connected with a part of the housing 1. The pivotal connection of the part 32 of the reaction arm 31 can be carried out, for example, by a pin 34 mounted on the housing 1 and extending through an opening 35 in the reaction arm 31. The end part of the reaction arm 31 is pivotally connected with the switching element 19 and in particular with its rod 20, for example, by a pin 36 mounted on the rod 20 and extending through an opening 37 provided in the reaction arm 31. Another portion 38 of the reaction arm 31 extends at the opposite side of an axis A of turning of the reaction arm and is configured for holding by an operator or abutting against an adjacent object.

The reaction arm with the power-driven torque intensifier in accordance with the present invention operate in the following manner:

In the position shown in the drawings the second coupling formed by the sun gear 6 connects the output shaft 5 of the single stage multiplier 4, driven by the motor 3, with the drive shaft 7 via the interengagement of the inner surface of the sun gear 6 with the outer surfaces of the shafts 5 and 7. When the output end 8 of the drive shaft 7 engages with a nut and the torque intensifier is switched on, the motor 3 turns the drive shaft 7 through the single stage multiplier 4 and the shaft 5 with a high speed and a low torque to run the nut down or up for tightening or loosening, for example for running the nut down on a bolt in an initial stage in which the nut is located at a distance from an object in which the bolt is inserted, with a high speed and a low torque.

When now it is necessary to tighten the nut on the bolt, a high torque with a low speed must be applied to the nut. For this purpose the reaction arm 31 is turned from the position shown in solid lines in the drawings to a position shown in broken lines. The portion 32 of the reaction arm 31 is turned around the axis A in a clockwise direction and pushes the rod 20 of the switching element 19 to the right in the drawings. The rod 20 with its projection 22 displaces the coupling of the sun gear 6 to the right in the drawing, so that the sun gear 6 disengages from the rear end of the drive shaft 7, while the outer teeth of the sun gear 6 engage with the outer teeth of the planetary gears 9 of the first stage of the multi-stage planetary gear set. At the same time the projection 21 of the rod 20 of the switching element 19 displaces the second coupling 16 to the right so that its projections 17 engage in the corresponding recesses of the carrier 24 of the second stage of the multi-stage planetary gear set.

When now the torque intensifier is turned on, the motor 3 rotates the output shaft 5 through the single stage multiplier 4, and the output shaft 5 rotates the sun gear 6 of the first stage which, in turn, rotates the planetary gears 9 engaged with the housing 1, so through that the planetary gears 9, the rotation is transmitted to the housing 1 which rotates about an axis B. The rotation of the housing 1 is transmitted to the planetary gears 13 of the second stage, whose teeth are engaged with the inner surface of the housing 1, and then through the shafts 14, the carrier 24, the projections 17, and the coupling 16 to the drive shaft. 7, which in turn, rotates the nut engaged by its output end 8. A gear ratio of the gears in the multi-stage planetary gear set is selected so that in this mode of operation the drive shaft 7 is rotated with a lower speed and a higher torque than in the above mentioned first mode of operation. The nut is therefore tightened with the high torque at low speed.

The position of the reaction arm 31 shown in solid lines in the drawings corresponds to the mode of operation in which the torque intensifier operates with a high speed and a low torque, while the position of reaction arm 31 shown in broken lines corresponds to the mode of operation when the torque intensifier operates with a high torque at a low speed.

In the above mentioned first mentioned position the reaction arm 31 extends substantially perpendicular to the axis B of the torque intensifier and the housing 1, while in the second mentioned position the reaction arm 31 extends substantially in a direction of the axis B of the torque intensifier and the housing 1.

In the position shown in the drawings with the reaction arm shown in solid lines, as mentioned herein above the torque intensifier operates with a high speed and a low torque, and an operator can hold the reaction arm, in particular its portion 38, because of the low torque. When however the torque intensifier must operate with a high torque at a low speed to tighten the nut, the high torque can not be absorbed by an operator, and the reaction arm 31, in particular in portion 38, abuts against an adjacent stationary object, for example a nut which is adjacent to the nut to be tightened.

It will be understood that each of the elements described above, or two or more together, may also find a useful application in other types of methods and constructions differing from the type described above.

While the invention has been illustrated and described as embodied in reaction arm for power-driven torque intensifier and low speed/high torque, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A reaction arm for a power-driven torque intensifier having a housing with an axis, torque intensifier means and switching means for switching the torque intensifier means between high speed/low torque and low speed/high torque, so that when said reaction arm is in a first position, the torque intensifier means operates with high speed/low torque and said reaction arm is usable as a handle by an operator, and when said reaction arm is in a second position the torque intensifier means operates with low speed/high torque and said reaction arm can abut against a stationary object since the high torque can not be absorbed by the operator, wherein said reaction arm is configured so that when it is placed in said first position it activates said switching means so that said switching means connects said housing and said torque intensifier means with one another to change from low speed/high torque to high speed/low torque.

2. A reaction arm for a power-driven torque intensifier having a housing with a longitudinal axis, torque intensifier means and switching means for switching the torque intensifier means between high speed/low torque and low speed/high torque, so that when said reaction arm is in a first position, the torque intensifier means operates with high speed/low torque and said reaction arm is movable relative to the housing and usable as said switching means and as a handle by an operator, and when said reaction arm is in a second position the torque intensifier means operates with low speed/high torque and said reaction arm can abut against a stationary object since the high torque can not be absorbed by the operator, wherein said reaction arm is configured so that in said second position it extends substantially in a direction of said longitudinal axis of said housing.

3. A power-driven torque intensifier with a reaction arm, comprising the torque intensifier including a housing with an axis, torque intensifier means and switching means for switching the torque intensifier means between high speed/ low torque and low speed/high torque; and so that when said reaction arm is in a first position, the torque intensifier means operates with high speed/low torque and said reaction arm is usable as a handle by an operator, and when said reaction arm is in a second position the torque intensifier means operates with low speed/high torque and said reaction arm can abut against a stationary object since the high torque can not be absorbed by the operator, wherein said reaction arm is configured so that when it is placed in said first position it activates said switching means so that said switching means connects said housing and said torque intensifier means with one another to change from low speed/high torque to high speed/low torque.

4. A power-driven torque intensifier with a reaction arm, comprising the torque intensifier including a housing with a longitudinal axis, torque intensifier means and switching means for switching the torque intensifier means between high speed/low torque and low speed/high torque; and so that when said reaction arm is in a first position, the torque intensifier means operates with high speed/low torque and said reaction arm is movable relative to the housing and usable as said switching means and as a handle by an operator, and when said reaction arm is in a second position the torque intensifier means operates with low speed/high torque and said reaction arm can abut against a stationary object since the high torque can not be absorbed by the operator, wherein said reaction arm is configured so that in said second position it extends substantially in a direction of said longitudinal axis of said housing.

5. A reaction arm for a power-driven torque intensifier having a housing with an axis, torque intensifier means and switching means for switching the torque intensifier means between high speed/low torque and low speed/high torque, so that when said reaction arm is in a first position, the torque intensifier means operates with high speed/low torque and said reaction arm is usable as a handle by an operator, and when said reaction arm is in a second position the torque intensifier means operates with low speed/high torque and said reaction arm can abut against a stationary object since the high torque can not be absorbed by the operator, wherein said switching means is configured so that when said reaction arm is moved from said first position to said second position, said reaction arm switches said torque intensifier means from the high speed/low torque to the low speed/high torque.

6. A power-driven torque intensifier with a reaction arm, comprising the torque intensifier including a housing with an axis, torque intensifier means and switching means for switching the torque intensifier means between high speed/low torque and low speed/high torque; and so that when said reaction arm is in a first position, the torque intensifier means operates with high speed/low torque and said reaction arm is usable as a handle by an operator, and when said reaction arm is in a second position the torque intensifier means operates with low speed/high torque and said reaction arm can abut against a stationary object since the high torque can not be absorbed by the operator, wherein said switching means is configured so that when said reaction arm is moved from said first position to said second position, said reaction arm switches said torque intensifier means from the high speed/low torque to the low speed/high torque.

* * * * *